US008707689B1

(12) United States Patent
Spencer-Smith et al.

(10) Patent No.: US 8,707,689 B1
(45) Date of Patent: Apr. 29, 2014

(54) EXHAUST SYSTEM FOR AN INTERNAL COMBUSTION ENGINE

(75) Inventors: Michael Spencer-Smith, Napa, CA (US); James Stewart Grant, Vallejo, CA (US); Louis Walch, American Canyon, CA (US); Adam Weidauer, Brentwood, CA (US)

(73) Assignee: Northern California Diagnostic Laboratories, Inc., Napa, CA (US)

( * ) Notice: Subject to any disclaimer, the term of this patent is extended or adjusted under 35 U.S.C. 154(b) by 292 days.

(21) Appl. No.: 13/135,777

(22) Filed: Jul. 14, 2011

(51) Int. Cl.
*F01N 3/00* (2006.01)

(52) U.S. Cl.
USPC ..... 60/324

(58) Field of Classification Search
USPC ..... 60/324, 323
See application file for complete search history.

(56) References Cited

U.S. PATENT DOCUMENTS

| | | | | | |
|---|---|---|---|---|---|
| 2,716,463 | A | | 8/1955 | Latulippe | |
| 3,710,891 | A | * | 1/1973 | Flugger | 181/256 |
| 3,765,505 | A | * | 10/1973 | Pendleton | 181/200 |
| 3,897,229 | A | | 7/1975 | Lada | |
| 4,098,174 | A | | 7/1978 | Landy | |
| 4,361,206 | A | * | 11/1982 | Tsai | 181/255 |
| 4,589,515 | A | | 5/1986 | Omura | |
| 4,673,058 | A | | 6/1987 | Roberts et al. | |
| 4,690,245 | A | * | 9/1987 | Gregorich et al. | 181/272 |
| 4,792,014 | A | | 12/1988 | Shin-Seng | |
| 4,909,034 | A | * | 3/1990 | Kakuta | 60/324 |
| 5,173,576 | A | | 12/1992 | Feuling | |
| 5,371,331 | A | | 12/1994 | Wall | |
| 5,563,382 | A | | 10/1996 | Choyce | |
| 6,105,716 | A | * | 8/2000 | Morehead et al. | 181/255 |
| 6,283,246 | B1 | | 9/2001 | Nishikawa | |
| 6,520,285 | B2 | | 2/2003 | Tobias | |
| 6,554,100 | B2 | | 4/2003 | Kim | |
| 6,688,425 | B2 | | 2/2004 | Cole et al. | |
| 6,810,992 | B1 | | 11/2004 | Lombardo | |
| 7,487,633 | B2 | * | 2/2009 | Popik et al. | 60/289 |
| 7,549,512 | B2 | * | 6/2009 | Newberry | 181/281 |
| 7,552,797 | B2 | | 6/2009 | Luttig | |
| 7,614,222 | B2 | * | 11/2009 | Hemingway et al. | 60/324 |
| 7,631,725 | B2 | | 12/2009 | Towne et al. | |
| 7,645,432 | B1 | * | 1/2010 | Solomon | 423/212 |
| 7,698,889 | B1 | | 4/2010 | Burk et al. | |
| 7,805,932 | B2 | | 10/2010 | Oxborrow | |
| 2005/0161283 | A1 | | 7/2005 | Emler | |
| 2007/0051557 | A1 | * | 3/2007 | Chang | 181/252 |
| 2009/0101434 | A1 | | 4/2009 | Sammut et al. | |
| 2009/0283358 | A1 | | 11/2009 | Hughey | |

* cited by examiner

*Primary Examiner* — Thomas Denion
*Assistant Examiner* — Jason Shanske
(74) *Attorney, Agent, or Firm* — Thomas R. Lampe

(57) ABSTRACT

An exhaust system for an internal combustion engine including an elongated tube for receiving exhaust gas and exhaust flow modification structure within the tube interior configured to cooperate with the elongated tube to produce a laminar flow of exhaust gas and modify the flow speed of the exhaust gas due to the venturi effect.

3 Claims, 4 Drawing Sheets

40
42

40

42
40

40
42

10
12
42
40

10
42
40
12

50
52

60
52
58
64
50
54
62

50
54

52
50
54

52
54
50

10
50
12

70
80
80
68
74
82
82
72

10
12
50
58

EXHAUST SYSTEM FOR AN INTERNAL COMBUSTION ENGINE

TECHNICAL FIELD

This invention relates to an exhaust system for an internal combustion engine. The invention is applicable to all internal combustion engines but has particular, but not-exclusive, application to internal combustion engines of motorcycles or other vehicles.

BACKGROUND OF THE INVENTION

In exhaust systems for internal combustion engines it is desirable to optimize velocity of exhaust flow to enhance engine performance. Turbulence in the exhaust flow and consequent build up of back pressure in the system is a major impediment to maximizing internal combustion engine performance. Poor performance of internal combustion engines employed with motorcycles and other vehicles, among other adverse consequences, results in failure of the vehicle to reach otherwise attainable speeds.

The following prior art having some degree of relevance to the present invention is known: U.S. Pat. No. 7,552,797, issued Jun. 30, 2009, U.S. Pat. No. 6,810,992, issued Nov. 2, 2004, U.S. Pat. No. 6,688,425, issued Feb. 10, 2004, U.S. Pat. No. 6,554,100, issued Apr. 29, 2003, U.S. Pat. No. 6,520,285, issued Feb. 18, 2003, U.S. Pat. No. 6,283,246, issued Sep. 4, 2001, U.S. Pat. No. 5,563,382, issued Oct. 8, 1996, U.S. Pat. No. 5,371,331, issued Dec. 6, 1994, U.S. Pat. No. 5,173,576, issued Dec. 22, 1992, U.S. Pat. No. 4,792,014, issued Dec. 20, 1988, U.S. Pat. No. 4,589,515, issued May 20, 1986, U.S. Pat. No. 2,716,463, issued Aug. 30, 1955, U.S. Patent App. Pub. No. US 2009/0283358, published Nov. 19, 2009, U.S. Patent App. Pub. No. US 2009/0101434, published Apr. 23, 2009, U.S. Patent App. Pub. No. US 2005/0161283, published Jul. 28, 2005, U.S. Pat. No. 7,805,932, issued Oct. 5, 2010, U.S. Pat. No. 7,631,725, issued Dec. 15, 2009, U.S. Pat. No. 3,897,229, issued Jul. 29, 1975, U.S. Pat. No. 4,098,174, issued Jul. 4, 1978, U.S. Pat. No. 7,698,889, issued Apr. 20, 2010 and U.S. Pat. No. 4,673,058, issued Jun. 16, 1987.

The above-identified prior art relates to various exhaust systems which incorporate structure affecting exhaust flow. The prior art does not teach or suggest the apparatus or method of the exhaust system disclosed and claimed herein.

DISCLOSURE OF INVENTION

As will be described in greater detail below, the present invention improves exhaust gas flow by producing a laminar flow of the exhaust gas and modifying the flow speed of the exhaust gas due to the venturi effect.

The subject exhaust system includes an elongated tube defining a tube interior for receiving exhaust gas from an internal combustion engine.

Exhaust flow modification structure is disposed within the tube interior, the exhaust flow modification structure having an outer surface spaced from the tube whereby the tube and the exhaust flow modification structure define an exhaust gas flow path surrounding the outer surface.

The outer surface is configured to produce a laminar flow of the exhaust gas and to modify flow speed of the exhaust gas due to the venturi effect within the tube interior.

The present invention also encompasses a method of improving the performance of an exhaust system for an internal combustion engine, the exhaust system including an elongated tube defining a tube interior for receiving exhaust gas from the internal combustion engine.

The method includes the step of positioning exhaust flow modification structure having an outer surface within the tube interior.

The outer surface is maintained spaced from the tube whereby the tube and the exhaust flow modification structure define an exhaust gas flow path surrounding the outer surface.

While flowing exhaust gas along the exhaust gas flow path, the exhaust flow modification structure is employed to produce a laminar flow of the exhaust gas and to modify flow speed of the exhaust gas due to the venturi effect within the tube interior.

Other features, advantages and objects of the present invention will become apparent with reference to the following description and accompanying drawings.

MODES FOR CARRYING OUT THE INVENTION

Figures 1, 2:
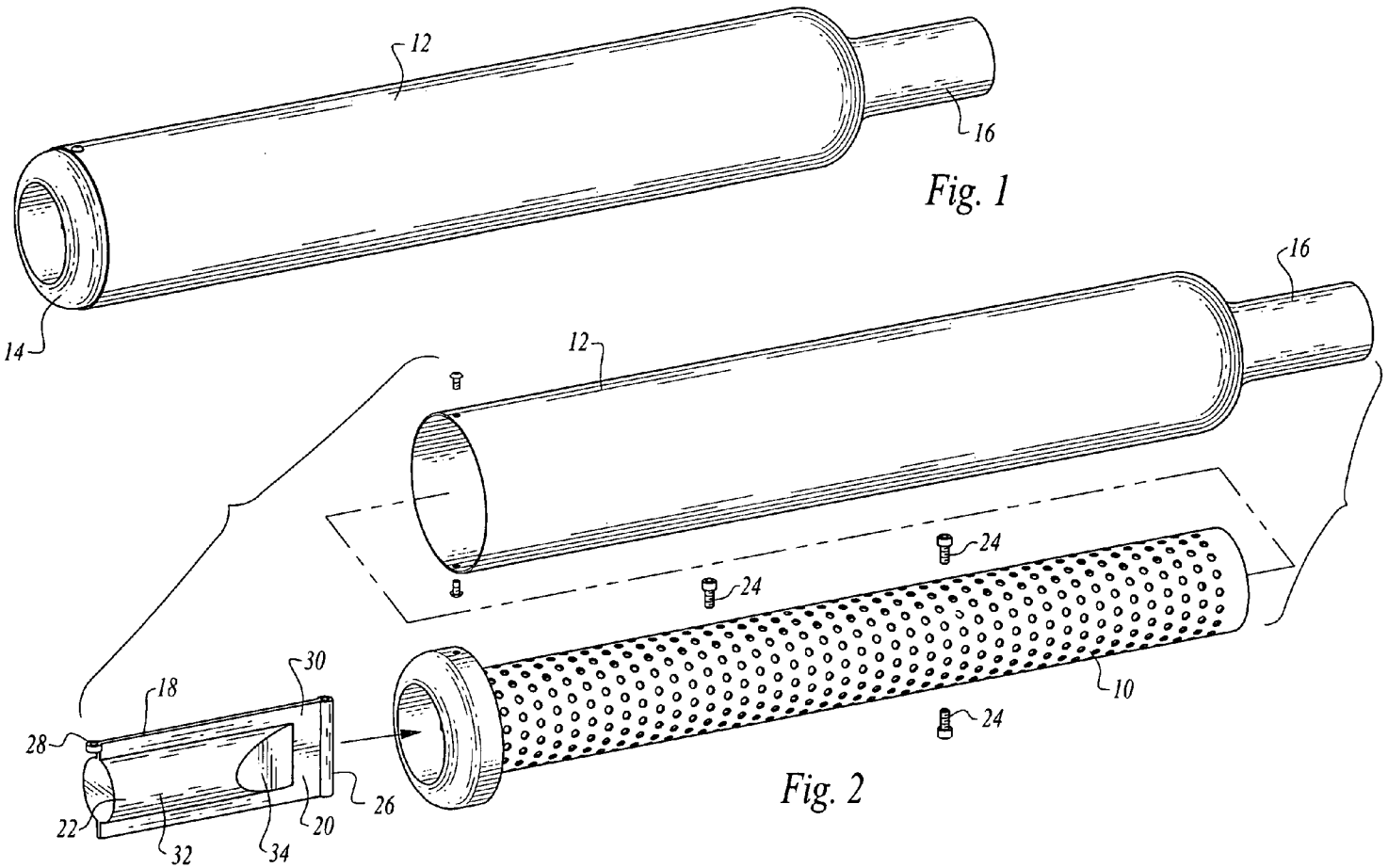
FIG. 1 is a perspective view illustrating a first embodiment of apparatus constructed in accordance with the teachings of the present invention.
FIG. 2 is an exploded, perspective view illustrating components of the apparatus shown in FIG. 1 prior to assembly.

FIGS. 1-8 illustrate a first embodiment of apparatus constructed in accordance with the teachings of this invention. The apparatus includes an elongated, perforated baffle tube 10 which is positionable in a muffler shell 12. This combination of structural elements is well known in the muffler and exhaust arts. An end cap 14 of the baffle tube is held in place relative to the muffler shell by screws or other suitable connector means.

The baffle tube 10 defines a tube interior for receiving exhaust gas from an internal combustion engine (not shown) through an exhaust entry pipe 16 of the muffler shell.

Prior to assembly of the baffle tube and the muffler shell, an exhaust flow modification structure 18 is inserted into the interior of the baffle tube. The exhaust flow modification structure 18 includes a front end portion 20 and a rear end portion 22. Pins 24 or other suitable mechanical connectors are utilized to secure the exhaust flow modification structure in place within the baffle tube interior, the pins positioned in receivers 26, 28 at the front end portion and rear end portion, respectively. Receivers 26, 28 are integrally attached to a centrally disposed plate-like mounting member 30 extending along the primary axis of the baffle tube.

The rear end portion 22 has an elongated rounded hemispherical shaped outer surface 32 projecting from each side of plate-like mounting member 30. The rear end portion is of generally uniform size and configuration. Front end portion 20, on the other hand, gradually increases in size in the direction of the rear end portion. More particularly, opposed beveled surfaces 34 extend from the sides of the plate-like mounting member 30 to the rounded surfaces 32 of the rear end portion.

Figures 3, 4, 5, 6, 7, 8:
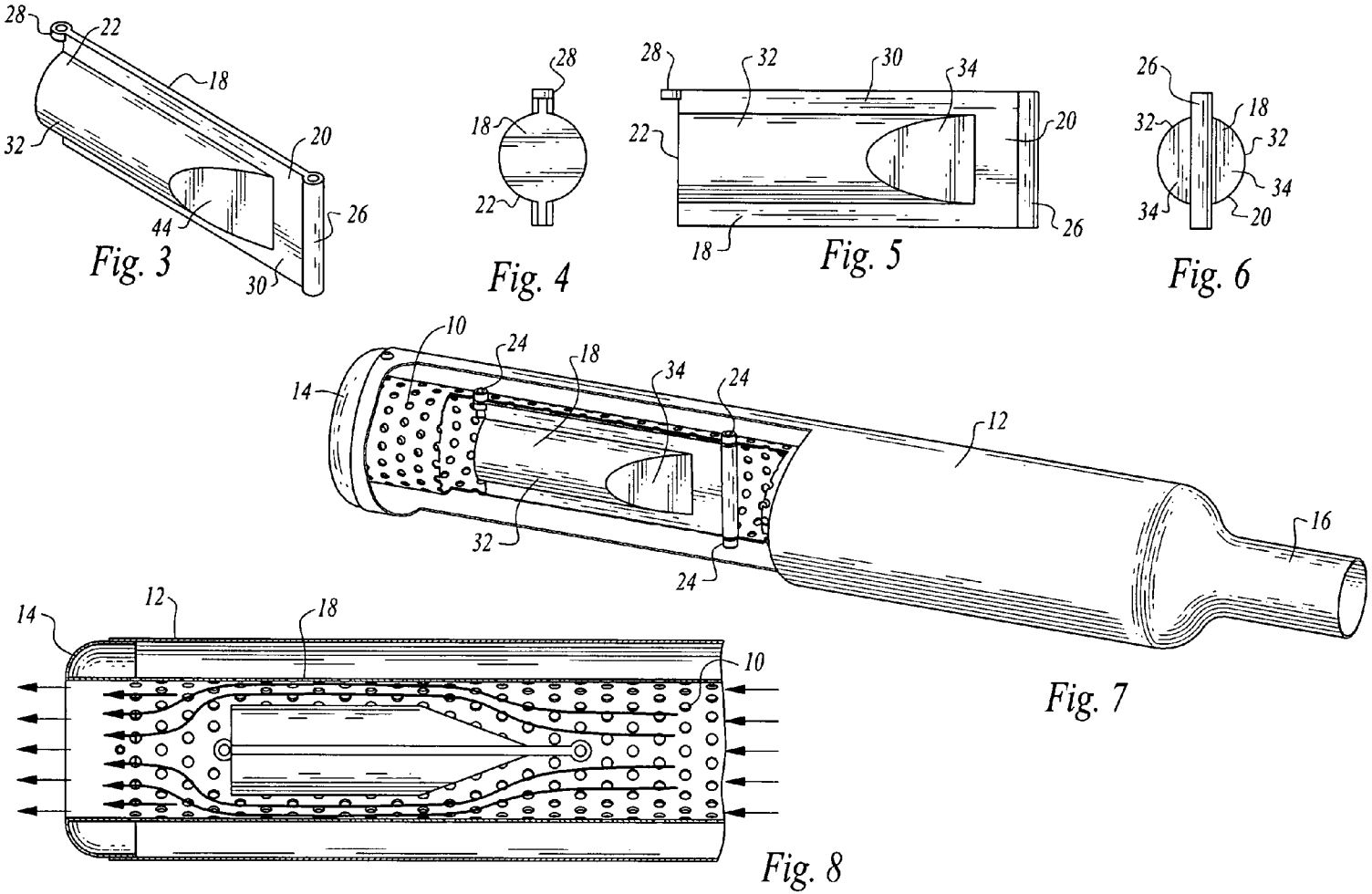
FIG. 3 is a perspective view of the exhaust flow modification structure of the apparatus.
FIG. 4 is an elevational view of the rear end portion of the exhaust flow modification structure.
FIG. 5 is a side, elevational view of the exhaust flow modification structure.
FIG. 6 is an elevational view of the front end portion of the exhaust flow modification structure.
FIG. 7 is a perspective view of the apparatus having a portion thereof broken away to show the exhaust flow modification structure inserted into and connected to a baffle tube, the baffle tube being disposed within a muffler shell.
FIG. 8 is a cross-sectional view providing a diagrammatic representation of exhaust flow within the baffle tube interior and around the exhaust flow modification structure.

FIG. 8 illustrates by arrows the flow of exhaust gas through baffle tube 10 and how such flow is modified as the exhaust gas flows through the exhaust gas flow path formed between the outer surface of the exhaust flow modification structure and baffle tube, such exhaust gas flow path surrounding the exhaust flow modification structure outer surface.

The outer surface is configured to produce a laminar flow of the exhaust gas and also to modify flow speed of the exhaust gas due to the venturi effect within the baffle tube interior. This results in a reduction of turbulence in the exhaust gas and in a reduction of back pressure inhibiting flow of exhaust gas into and through the interior of the perforated baffle tube.

The exhaust flow modification structure may be one of a plurality of exhaust flow modification structures selectively alternatively releasably connected to the baffle tube, the exhaust flow modification structures having different physical and performance characteristics, one or several of which may be more applicable for use than others in a particular exhaust system environment.

FIGS. 9-14 illustrate a second embodiment of the invention and wherein like reference numbers are employed when the structural components are the same as that of the first embodiment.

In this second embodiment the only structural element change is with respect to the exhaust flow modification structure, identified in this embodiment by reference numeral 40. Rather than utilize opposed planar beveled surfaces to provide an interface between the elongated rounded outer surfaces of the rear end portion of this embodiment, the transition from the plate-like mounting member to the elongated rounded surfaces is by a hemi-conical surface 42 on each side of the mounting member.

Figures 9, 10, 11, 12, 13, 14:
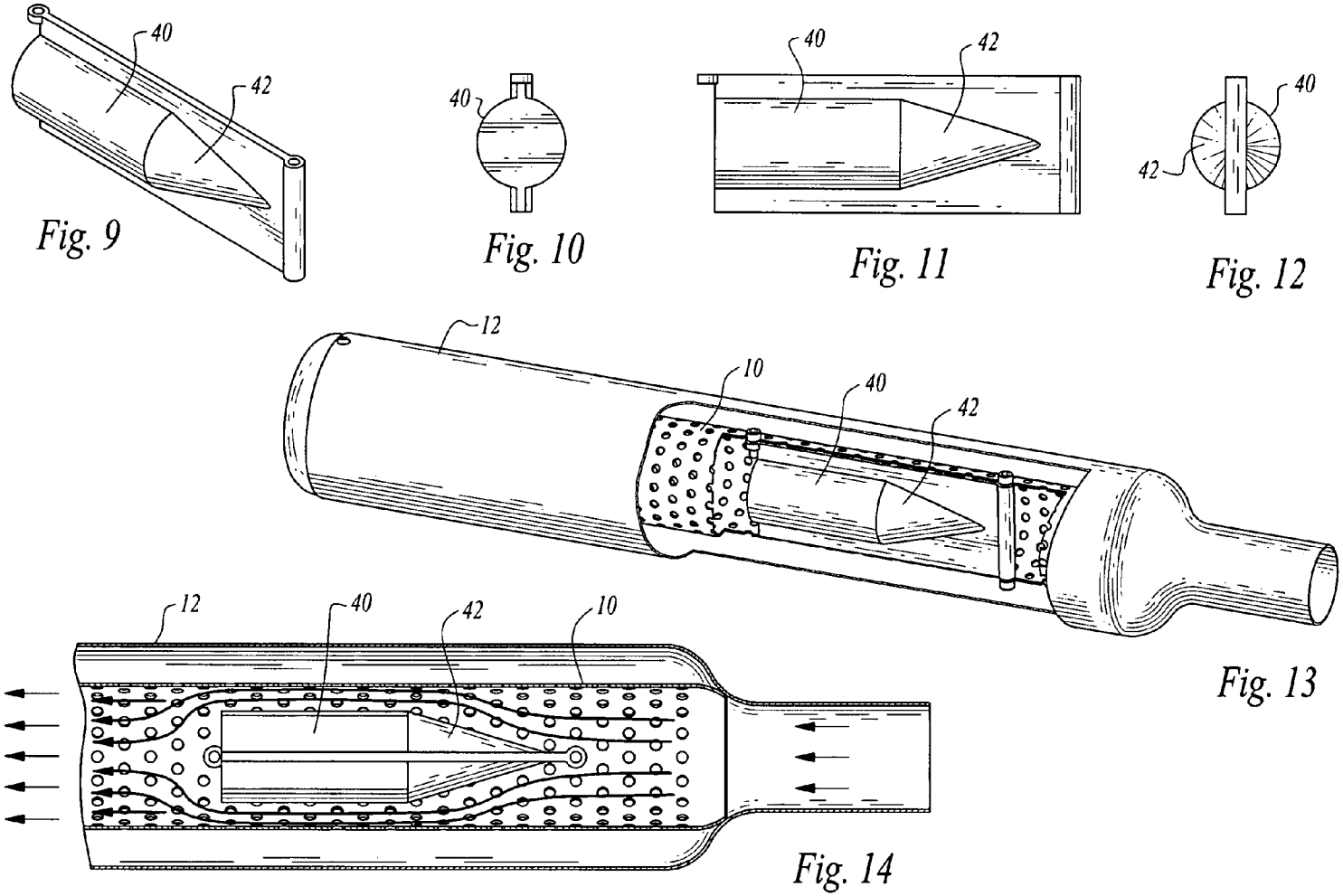
FIG. 9 is a perspective view of a second embodiment of exhaust flow modification structure.
FIG. 10 is an elevational view of the rear end portion of the exhaust flow modification structure of FIG. 9.
FIG. 11 is a side, elevational view of the exhaust flow modification structure of FIG. 9.
FIG. 12 is an elevational view of the front end portion of the embodiment of the exhaust flow modification structure of FIG. 9.
FIG. 13 is a view similar to FIG. 7, but illustrating the second embodiment of the exhaust flow modification structure in the baffle tube.
FIG. 14 is a view similar to FIG. 8, but illustrating the exhaust flow modification structure of FIG. 9 and exhaust flow.

FIG. 14 illustrates the flow of exhaust gases through baffle tube 10 and around exhaust flow modification structure 40. This arrangement, like that of the first embodiment, results in modification of the exhaust flow by producing a laminar flow of the exhaust gas and by modifying the flow speed of the exhaust gas due to the venturi effect within the tube interior.

FIGS. 15-21 disclose a third embodiment wherein all structural components previously described are the same except for the exhaust flow modification structure, which in this third embodiment is identified by reference numeral 50. In this embodiment exhaust flow modification structure 50 includes a front end portion 52 having a hemi-conical outer surface. Rear end portion 54 has a cylindrically-shaped outer surface.

Figures 15, 16, 17, 18, 19, 20, 21, 22:
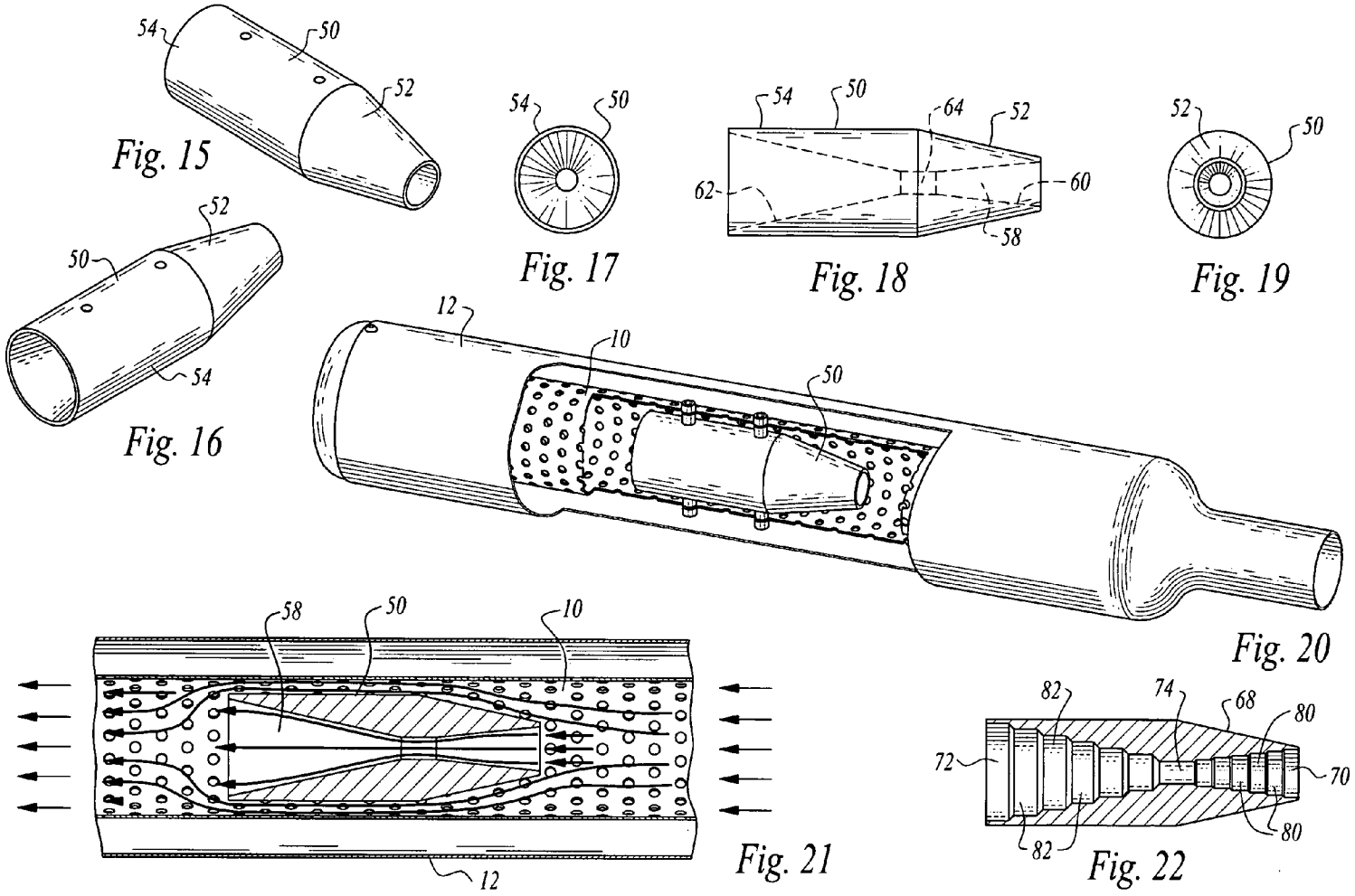
FIG. 15 is a front, perspective view of a third embodiment of exhaust flow modification structure.
FIG. 16 is a rear, perspective view of the third embodiment of exhaust flow modification structure.
FIG. 17 is an elevational view of the rear end portion of the third embodiment of exhaust flow modification structure.
FIG. 18 is a side, elevational view of the third embodiment of the exhaust flow modification structure and illustrating with dash lines the configuration of an inner venturi exhaust flow path formed thereby.
FIG. 19 is an elevation view of the front end portion of the third embodiment of exhaust flow modification structure.
FIG. 20 is a view similar to FIGS. 7 and 13, but illustrating the third embodiment of exhaust flow modification structure within and connected to the system baffle tube.
FIG. 21 is a view similar to FIGS. 8 and 14, but illustrating the third embodiment of exhaust flow modification structure within the baffle tube and utilized to modify exhaust gas flow.
FIG. 22 is a side, elevational, cross-sectional view of a fourth embodiment of exhaust flow modification structure.

Exhaust flow modification structure 50 defines an internal exhaust gas flow passageway 58 formed by an inner surface configured to form an internal venturi having a converging inlet nozzle portion 60, a diverging outlet diffuser portion 62 and a gas flow restricting throat portion 64 interconnecting the converging inlet nozzle portion and the diverging outlet diffuser portion (see FIG. 18).

FIG. 21 illustrates the exhaust flow modification structure 50 in place within baffle tube 10, exhaust gas flow illustrated by arrows. As may be seen with reference to this latter figure, a portion of the exhaust gas in the baffle tube interior flows through internal gas flow passageway 58 which is configured to modify the flow speed of that portion of the exhaust gas due to the venturi effect.

At low velocities, the inner venturi causes pressures at the inlet of the venturi to increase the fluid acceleration around the front of the exhaust flow modification structure, aiding low-end torque. At mid to high velocities the venturi converts the pressure energy at the inlet into velocity energy creating a low-pressure or vacuum shown both through the exhaust flow modification structure and around the back thereof, aiding in both peak torque and top RPM performance of the internal combustion engine associated with the system.

FIG. 22 illustrates yet another embodiment 68 of exhaust flow modification structure which also incorporates an inner venturi. In this instance the venturi has been designed with multiple stages to further improve efficiency.

Exhaust flow modification structure 68 incorporates a converging inlet nozzle portion 70, a diverging outlet diffuser portion 72 and a gas flow restricting throat portion. The inner surface of the internal exhaust gas flow passageway has a plurality of interconnected inner surface portions of different diameters at the inlet nozzle portion and at the outlet diffuser portion creating a multi-stage venturi. Some of the inner surface portions of the inlet nozzle portion are identified by reference numeral 80 and some of the inner surface portions of the outlet diffuser portion are identified by reference numeral 82.

Tests indicate that the multi-stage type venturi generates a wider range of higher pump/vacuum rates and velocities compared to the single-stage type venturi. Similar in effect to a multi-stage ejector, the multi-stage venturi is beneficial for exhaust applications which benefit from high operational efficiency in the presence of fluctuating compressible-gas (fluid) pressures occurring at varying RPM's.

The present invention is not limited to the disclosed embodiments thereof and changes can be made without departing from the spirit or scope of the invention. For example, the exhaust flow modification structure is not limited to the specific configurations disclosed and the exhaust flow modification structure can be fixed in place rather than added as an insert. The principles of the invention may be applied to a non-perforated tube rather than to a perforated baffle tube and the tube may or may not be placed within a muffler shell.

The invention claimed is:

1. An exhaust system for an internal combustion engine, said exhaust system comprising, in combination:

an elongated muffler shell defining a muffler shell interior;

an elongated tube positioned within said muffler shell interior extending along the elongated muffler shell and defining a tube interior for receiving exhaust gas from the internal combustion engine, said elongated tube in said muffler shell interior defining a plurality of spaced openings about the periphery thereof along the length thereof, and said elongated muffler shell and said elongated tube spaced apart and defining an open-ended first exhaust gas passageway therebetween surrounding the elongated tube and extending along the elongated tube in said muffler shell interior; and exhaust flow modification structure within said tube interior having an outer surface spaced from said elongated tube whereby said elongated tube and said exhaust flow modification structure define an exhaust gas flow path surrounding said outer surface and extending the length of said exhaust flow modification structure, said outer surface configured to produce a laminar flow of said exhaust gas and to modify flow speed of said exhaust gas due to the venturi effect within said tube interior, said exhaust flow modification structure defining a second exhaust gas passageway in the form of an internal exhaust gas flow passageway through which a portion of the exhaust gas in said tube interior flows during operation of the internal combustion engine, said internal exhaust flow passageway configured to modify flow speed of the portion of exhaust gas due to the venturi effect, said exhaust flow modification structure having an inner surface defining said internal exhaust gas flow passageway and said inner surface configured to form an internal venturi having a converging inlet nozzle portion for receiving exhaust gas from said elongated tube, a diverging outlet diffuser portion for discharging gas received thereby back to said elongated tube and a gas flow restricting throat portion interconnecting said converging inlet nozzle portion and said diverging outlet diffuser portion.

2. The exhaust system according to claim 1 additionally comprising connector structure, said connector structure releasably connecting said exhaust flow modification structure to said elongated tube.

3. A method of improving the performance of an exhaust system for an internal combustion engine, the exhaust system including an elongated muffler shell having a muffler shell interior and an elongated tube defining a tube interior for receiving exhaust gas from the internal combustion engine, said elongated tube in said muffler shell interior defining a plurality of spaced openings about the periphery thereof along the length thereof, said method comprising the steps of:

maintaining said elongated muffler shell and said elongated tube spaced apart to define an open-ended first exhaust gas passageway therebetween surrounding the elongated tube and extending along the elongated tube in the muffler shell interior;

positioning exhaust flow modification structure having an outer surface within said elongated tube interior;

maintaining said outer surface spaced from said tube whereby said elongated tube and said exhaust flow modification structure define an exhaust gas flow path surrounding said outer surface and extending the length of said exhaust flow modification structure; and while flowing exhaust gas along said exhaust gas flow path, employing said exhaust flow modification structure to produce a laminar flow of said exhaust gas and to modify flow speed of said exhaust gas due to the venturi effect within said tube interior, said exhaust flow modification structure defining a second exhaust gas passageway in the form of an internal exhaust gas flow passageway through which a portion of the exhaust gas in said tube interior flows during operation of the internal combustion engine, said internal exhaust flow passageway configured to modify flow speed of the portion of exhaust gas due to the venturi effect, said exhaust flow modification structure having an inner surface defining said internal exhaust gas flow passageway and said inner surface configured to form an internal venturi having a converging inlet nozzle portion for receiving exhaust gas from said elongated tube, a diverging outlet diffuser portion for discharging gas received thereby back to said elongated tube and a gas flow restricting throat portion interconnecting said converging inlet nozzle portion and said diverging outlet diffuser portion.

* * * * *